US008978820B2

(12) United States Patent
Marini

(10) Patent No.: US 8,978,820 B2
(45) Date of Patent: Mar. 17, 2015

(54) TRAVELING FALL PROTECTION SYSTEM

(75) Inventor: Solomon Marini, Littleton, MA (US)

(73) Assignee: 3M Innovative Properties Company, St. Paul, MN (US)

( * ) Notice: Subject to any disclaimer, the term of this patent is extended or adjusted under 35 U.S.C. 154(b) by 1819 days.

(21) Appl. No.: 11/696,412

(22) Filed: Apr. 4, 2007

(65) Prior Publication Data

US 2008/0041660 A1 Feb. 21, 2008

Related U.S. Application Data

(60) Provisional application No. 60/788,910, filed on Apr. 4, 2006.

(51) Int. Cl.
*A62B 35/00* (2006.01)
*E04G 21/32* (2006.01)

(52) U.S. Cl.
CPC ..... *A62B 35/0068* (2013.01); *A62B 35/0056* (2013.01); *E04G 21/3261* (2013.01)
USPC ..... 182/36

(58) Field of Classification Search
CPC ..... A62B 35/0056; A62B 35/0068
USPC ..... 182/36
See application file for complete search history.

(56) References Cited

U.S. PATENT DOCUMENTS 2,812,010 A * 11/1957 Abdallah ..... 482/69
3,294,252 A * 12/1966 Hosoi et al. ..... 212/312
3,379,439 A 4/1968 Sorenson et al.
4,607,724 A 8/1986 Hillberg
4,674,596 A * 6/1987 Weiner et al. ..... 182/3
5,522,472 A 6/1996 Shuman, Jr.
5,626,540 A * 5/1997 Hall ..... 482/69
6,148,580 A 11/2000 Weir
6,474,442 B1 * 11/2002 Atkinson et al. ..... 182/36
6,779,630 B2 * 8/2004 Choate ..... 182/36

(Continued)

FOREIGN PATENT DOCUMENTS

DE 32 15 328 10/1983
DE 3215328 A1 * 10/1983

(Continued)

OTHER PUBLICATIONS

International Search Report; PCT/US2007/008459; Oct. 16, 2007.

*Primary Examiner* — Alvin Chin-Shue
(74) *Attorney, Agent, or Firm* — Kenneth B. Wood

(57) ABSTRACT

The invention provides a fall protection system for an individual maneuvering about a structure, the structure having structure sections disposed equidistant from each other and at least one transverse section extending between the equidistant sections, the system generally including a first cable support disposed on one of the equidistant structure sections, a second cable support disposed on another of the equidistant structure sections, a transverse cable support extending between the first and second cable supports, a rigid member operably associated with the transverse cable support and configured to span the distance between the first and second cable supports, and a personal fall arrest assembly attached to and movable relative to the transverse cable support, the transverse cable support and the rigid member are further configured to move relative to the equidistant and transverse structure sections and relative to the first and second cable supports.

15 Claims, 10 Drawing Sheets

(56) References Cited

U.S. PATENT DOCUMENTS

| | | | | |
|---|---|---|---|---|
| 7,131,936 | B2 * | 11/2006 | Schlosser | 482/69 |
| 7,351,155 | B2 * | 4/2008 | Lickle | 472/89 |

FOREIGN PATENT DOCUMENTS

| | | |
|---|---|---|
| EP | 1 400 642 | 3/2004 |
| GB | 2 397 845 | 8/2004 |

* cited by examiner

FIG. 5

Test set up:
Two 60′ Skywalk systems mounted in poured in place receiving cups parallel to each other 17′ apart.
One "bridle" consisting of a telescoping pipe with a 5/16″ cable secured to it and connected to the two Skywalk systems by means of pulleys.
Two test weights connected to the bridle cable with 3310 style retractable lanyards.

Procedure:
System set up as per above.
Two test weights pushed off work platform simultaneously.
Resulting sags and deployments measured and recorded as follows.

| | SW cable #1 | Bridle cable | | SW cable #2 |
|---|---|---|---|---|
| | | Wt #1 | Wt #2 | |
| Initial sag | 0″ | 6″ | | 0″ |
| Final sag | 33″ | 13″ | | 28″ |
| PB deploy | 1/4″ | | | 1/4″ |
| Retract deploy | | 4″ | 7″ | |
| Total fall distance | | 42″ | 45″ | |

TRAVELING FALL PROTECTION SYSTEM

CROSS REFERENCE TO RELATED APPLICATION

This application claims benefit of priority to U.S. Application Ser. No. 60/788,910 filed on Apr. 4, 2006, the entirety of which is hereby incorporated by reference.

TECHNICAL FIELD OF INVENTION

The invention generally relates to personal fall protection devices and, more particularly, to a fall protection assembly which permits an individual to move in multiple dimensions on a structure while providing fall arrest safety features and protecting against swing falls.

BRIEF DESCRIPTION OF RELATED ART

Personal fall protection assemblies are commonly used by individuals exposed to heights. For example, in construction or maintenance of buildings, bridges, towers, and the like, workers often perform tasks at higher elevations at or near an edge of a structure from which a fall could result in injury. Fall protection assemblies employed in such situations conventionally include a safety harness worn by the individual worker which is connected to a safety cable or line that is anchored, in one of various ways, to the structure upon which the individual is working. These assemblies are designed to reliably arrest the descent of the work if a fall should occur.

However, many of these conventional fall protection assemblies do not offer the worker sufficient freedom to move about a structure and perform their work effectively. Further, there are often considerable difficulties in achieving the necessary mechanical strength to arrest the fall of an adult worker. This is because such safety assemblies are temporary in nature and thus must be light enough to raise, maneuver, and erect upon the structure and yet strong enough to provide sufficient fall arrest capabilities.

Horizontal lifeline arrangements are often used to provide fall protection for individuals at these elevated positions on a structure. In these arrangements, a horizontal safety line is mounted upon the structure by way of mounting stanchions or other vertical supports. The horizontal line traverses the structure near an edge and is disposed typically above the height of a an average worker that that the worker can freely walk on the structure beneath the horizontal line. The individual worker is tethered to the horizontal line by a safety line extending from worker's harness. This horizontal lifeline arrangement allows the worker to move along the horizontal line while limiting movement in the vertical direction, e.g. to prevent falling. That is, should the worker fall when connected to such horizontal lifeline arrangement, the worker's descent will be arrested by the interaction of the horizontal line and the safety line tethering the worker.

While this horizontal lifeline arrangement ceases a vertical drop, the worker is still nonetheless exposed to dangers associated with a swing fall. This occurs when a worker falls from a position other than directly beneath the horizontal lifeline and results in a pendulum-like swing of the fallen worker exposing the worker to collision hazards with the building structure. For example, a worker tethered to a horizontal lifeline may maneuver outward from the horizontal lifeline on a cross-beam, etc., in a direction generally transverse to the horizontal line. A fall from such position would result in downward and horizontal acceleration forces sending the worker into a dangerous swing beneath the horizontal line.

Accordingly, a fall protection assembly is desired which has the necessary mechanical strength to arrest the fall of a worker, limits the vertical direction the worker may travel in the case of a fall, reduces occurrence of swing falls, and still provides the worker with sufficient capability for movement along and about a structure in order to perform required work, maintenance, etc.

BRIEF SUMMARY OF THE INVENTION

The above discussed and other problems and deficiencies of the prior art are overcome or alleviated by the invention, which provides a novel and nonobvious fall protection system.

The invention provides a fall protection system for an individual maneuvering about a structure, the structure having structure sections disposed equidistant from each other and at least one transverse section extending between the equidistant sections. The system generally comprises a first cable support disposed on one of the equidistant structure sections, a second cable support disposed on another of the equidistant structure sections, a transverse cable support extending between the first and second cable supports, a rigid member operably associated with the transverse cable support and configured to span the distance between the first and second cable supports, and a personal fall arrest assembly attached to and movable relative to the transverse cable support. The transverse cable support and the rigid member are further configured to move relative to the equidistant and transverse structure sections and relative to the first and second cable supports.

The invention further provides a fall protection system for an individual maneuvering about a structure, the structure having structure sections disposed opposite from each other and at least one transverse section extending between the opposite structure sections. Here, the system comprises a first support element extending above a first of the opposite structure sections, a second support element extending above a second of the opposite structure sections, a third support element connected to and movably associated with the first and second support elements, the third support element extending between the first and second support elements, and a fall arrest assembly connected at one end in movable association with the third support element and connected at another end to the individual. The first, second, and third support elements comprise cables which are configured to resist horizontal and vertical forces associated with a fall of the individual from the structure. The third support member further comprises a rigid member for resisting horizontal forces associated with said fall.

The invention also provides a fall protection system for an individual on a structure where the system comprises a support point and a fall arrest assembly connected to the support point and connected to the individual. The support point is configured to move with the individual about the structure. The fall arrest assembly comprises one or more cables to support vertical loads and a rigid member to resist compression forces associated with said loads.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 5 includes testing data relative to the invention; and

DETAILED DESCRIPTION OF THE INVENTION

Figure 1:
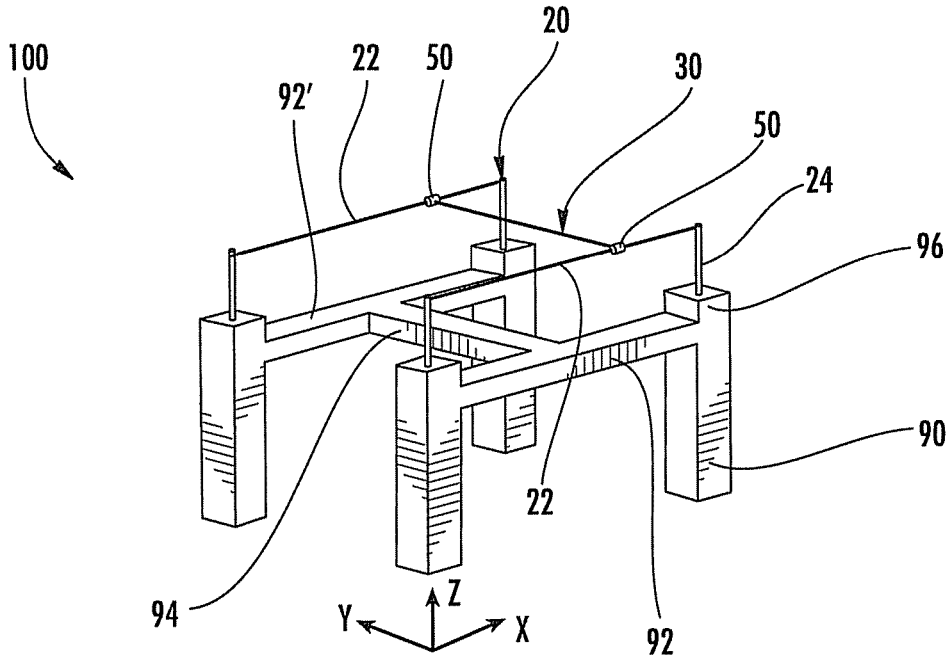
FIG. 1 is a perspective view of a fall protection system in one embodiment of the invention.
Figure 2:
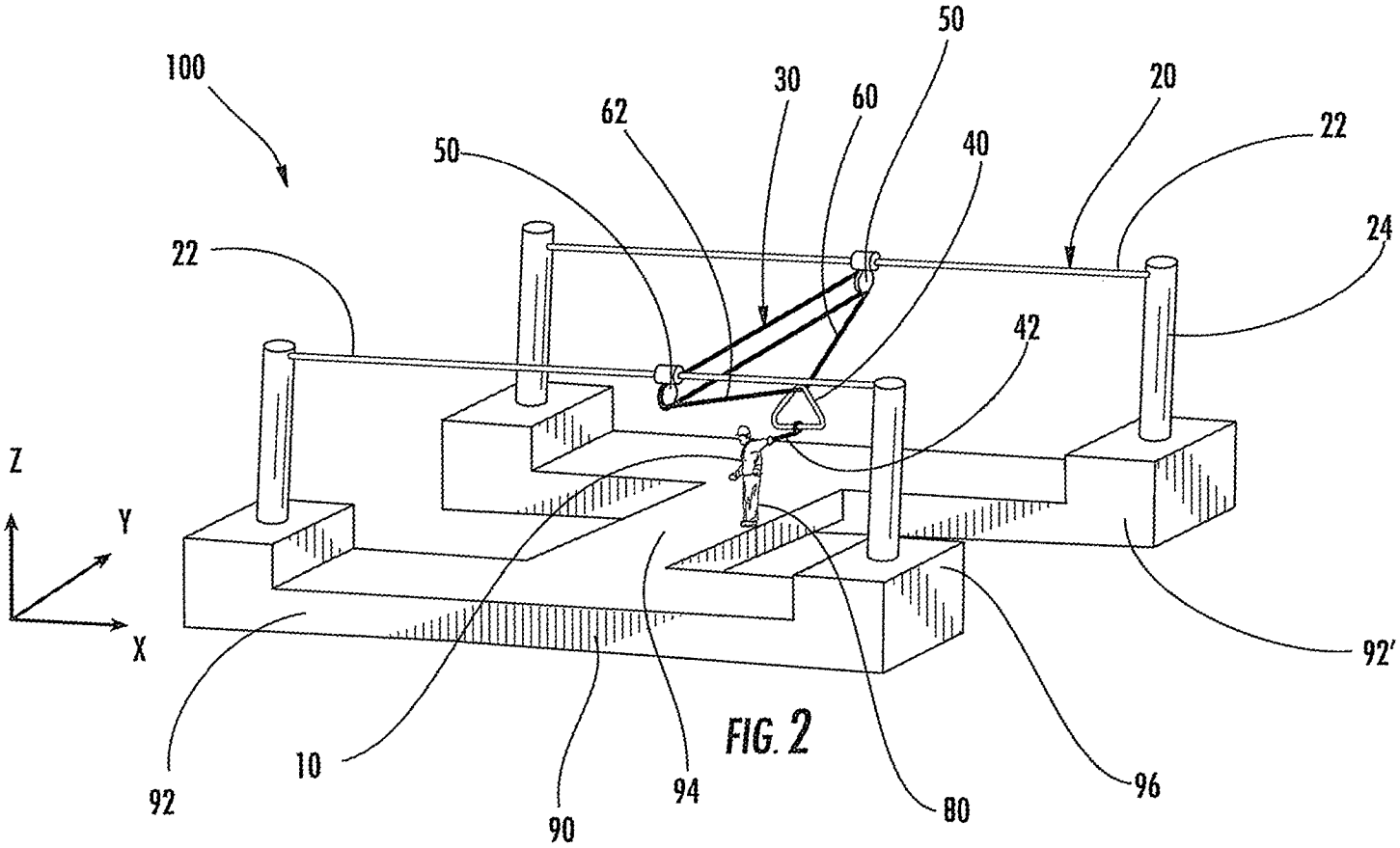
FIG. 2 is another perspective view of the fall protection system of FIG. 1 including an individual connected thereto.

FIGS. 1 and 2 show a fall protection system 100 in one exemplary embodiment of the invention. The fall protection system 100 is shown being used by a worker 10 to maneuver about a structure 90. The structure 90 may occupy an elevated position such as is common during construction, maintenance or similar activities with respect to buildings, bridges, walls, towers or like structures which require a worker 10 to perform work at an elevated distance above the ground. The fall protection system 100 may generally be employed anywhere fall protection is required by safety standards or other similar regulations to prevent or reduce serious injury to the worker 10 should they somehow slip or fall from the elevated position.

FIGS. 1 and 2 show the structure 90 as generally including two parallel structure section 92 and 92'. A transverse section 94 extends between the structure sections 92, 92' and in this example is shown generally perpendicular to the structure sections 92, 92' but may be disposed at an angle thereto, etc. The structure sections 92, 92' generally represent adjacent parallel structure segments disposed on any structure (building, bridge, tower, etc.). The transverse section 94 generally represents any cross segment which may be disposed between the structure sections 92, 92'.

Structure sections 92, 92' may be composed of rails, beams, I-beams, walls or the like, or any combination of these items relative to the particular building, bridge, wall, tower or like object which the structure 90 is associated with. It should be evident that other elements characterizing the shape, dimensions or configuration of structure sections 92, 92' used in the context of the claimed invention are well known and need not be addressed further.

The structure sections 92, 92' include fall protection traveler assembly 20 for providing fall protection to the worker 10 and for allowing movement of the worker 10 moving relative to the structure sections 92, 92', 94. The fall protection traveler assembly 20 is generally anchored to the structure 90 or some other non-movable object. This anchoring includes the use of a vertical element 24, such as a stanchion or other suitable object, as shown in the embodiment of FIGS. 1 and 2. While there is a vertical element 24 proximate each end of the structure sections 92, 92', it is possible to have any of a number of vertical elements 24 or anchoring points for the fall protection traveler assembly 20 along the structure sections 92, 92'. For example, an additional vertical element 24 may be disposed at mid-length along one or both of the structure sections 92, 92'. The vertical supports 24 may be mounted upon the structure sections 92, 92' by way of welding, bolting, etc., or any combination of these.

The use of the vertical elements 24 to affix the fall protection traveler assembly 20 to the structure 90 is discussed herein by way of example only. The assembly 20 may generally be fixed to the structure 90 in any manner sufficient to provide adequate securement. For example, the fall protection traveler assembly 20 may be alternatively affixed directly to elements of the structure 90, for example, directly to vertical beams of the structure 90, etc.

As shown in FIG. 1, the fall protection traveler assembly 20 includes flexible support elements 22 which span at least a portion of each of the structure sections 92, 92'. Opposing ends of each of the support elements 22 are attached to the vertical elements 24. Thus, in this exemplary embodiment, four vertical elements 24 are employed. The support elements 22 are maintained generally in a substantially taut condition between the vertical elements 24. The flexible support elements 22 are attached to the vertical elements 24 by any desired suitable means such as bolting, tying, etc. The flexible support elements 22 may be steel wire, cable-like, or some similar element of sufficient mechanical strength to decelerate and arrest a fall of the worker 10, as discussed further herein. The flexible support elements 22 may include tensioning or shock absorbing devices in order to decelerate the fall prior to full fall arrest and to generally absorb shock forces associated with fall arrest. The vertical elements 24 may be configured to suspend the flexible support elements 22 above the head of the worker 10 so that the worker 10 may move beneath the support elements 22 free from contact therewith.

The fall protection traveler assembly 20 further includes a rigid member 30 extending transversely between the flexible support elements 22, as shown in FIGS. 1 and 2. The worker 10 is tethered to the rigid member 30 by a harness 80 worn on the person of the worker 10 and a line arrangement 60 extending between the harness 80 and the rigid member 30. The rigid member 30 is particularly configured to move relative to the support elements 22. Movement of the rigid member 30 may be achieved by mechanically or electrically assisted means, but it is preferred that the rigid member 30 be manually movable by the worker 10, such as by pushing or pulling.

The fall protection traveler assembly 20 is sufficiently configured to support and secure the rigid member 30 as it is moved relative to the support elements 22. For example, the flexible support elements 22 and vertical elements 24 sustain the weight of the rigid member 30 and also prevent the rigid member 30 from moving beyond the vertical element 24. Additionally, the fall protection traveler assembly 20 is of sufficient mechanical strength to sustain the vertical force as a result of the fall of a worker 10 tethered to the rigid member 30, as will be discussed in more detail herein.

The rigid member 30 is of sufficient length to extend between the support elements 22 and is constructed of a substantially stiff or inelastic material, such as steel, plastic, etc., that will stay rigid and generally resist bending as a result of compression forces created during a fall of the worker 10, as will be discussed more in detail herein. The rigid member 30 may comprise any one of a tube, a pipe, a bar, a pole, a rail, a rod, a beam, an I-Beam or the like, and be of any shape or cross-sectional profile maintaining stiffness or inelasticity commensurate with the material of which it is composed.

In one example, the rigid member 30 comprises an elongated tube which is affixed at either of its ends to the flexible support elements 22 by pulley arrangements 50 which allow the rigid member 30 to move upon the elements 22. This tubular rigid member 30 may further include a line (not shown) extending through an interior of the tube. Opposite ends of the line may be affixed to the pulley arrangements 50 such that the line further supports the rigid member (and a fallen worker) between the flexible support elements.

In another example, the rigid member 30 is not connected directly to the pulley arrangements 50. Instead the rigid member 30 may simply extend over and essentially hang upon the line arrangement 60 which is connected at its ends to the pulley arrangements 50. Here, the rigid member generally extends towards the ends of the line arrangement 60 and is supported in the vertical direction by the line arrangement 60, but does not connect directly to the flexible support elements 22. Instead, the two ends of the line are moveably connected to the support elements 22 at the pulley arrangements 50 such that the assembly of the line arrangement 60 and the rigid member 30 extends between the support elements 22 and may selectively move along the support elements 22.

Where the distance between structure sections 92, 92' is substantial, the rigid member 30 length would consequently be substantial and may provide some difficulty in transporting the rigid member 30 between work sites. As a result, it may be desirable for the rigid member 30 to be of a reasonably transportable length. While the rigid member 30 may be a single piece unit, it is also contemplated that the rigid member 30 may be of a sectional construction. In this manner, the rigid member 30 could be converted into a manageable length for transport between work sites and then converted into a fixed appropriate length for use with the structure 90 at the site. For example, the rigid member 20 may comprise a plurality of tubular sections which may be bolted together onsite to provide the rigid member 30 of sufficient length.

The line arrangement 60 which attaches the harness 80 of the worker 10 to the rigid member 30 and/or to the flexible support elements 22 comprises any suitable arrangement that allows sufficient movement of the worker 10 relative to the rigid member 30 and that is sufficient to sustain the vertical force in the case of a fall of the worker 10. Such arrangement 60 may include a safety lifeline, a retractable lifeline, a lanyard, associated clips, snaphooks, d-rings and other attachment devices, or other mechanisms that are generally used to tether persons a safety line or similar device.

In one exemplary embodiment, the line arrangement 60 comprises two individual lines 62 which descend from opposite ends of the rigid member 30 and attach to a support member 40. In another embodiment, the line arrangement 60 comprises one continuous line which is attached at its ends to the pulley arrangements 50 and which supports the rigid member 30. The line arrangement 60 may further include a line extending through a hollow interior of the rigid member 30 to provide vertical support thereto. Beneath the line arrangement 60, a harness line 42 descends from the support member 40 and attaches to the harness 80 of the worker 10. The support member 40 may be fixed relative to the descending lines 62 of the line arrangement 60 or may be movable with respect thereto.

In one embodiment, the line arrangement 60 includes a single line 62 which traverses through the tubular rigid member 30 and then descends downward to the support member 40 which is movably attached to the line 62. Here, the line 62 may be directly connected to the pulley arrangements 50 at the ends of the rigid member 30 or may alternatively be disposed freely therefrom. In this latter version, the rigid member 30 is connected to the pulley arrangements 50. In the former version, the line 62 is a continuous loop which is connected to and runs from one pulley arrangement 50, through the rigid tube support member 30, to the opposite pulley arrangement 50, and down to the support member 40. The rigid member 30 essentially rides on the portion of the line 62 which extends through the member 30 between the pulley arrangements 50. The support member 40 is movably connected to the line 62 by way of a ring, pulley arrangement, etc., or by any means suitable to allow movement of the support member 40 relative to the line 62 and to provide sufficient strength to endure forces associated with a fall of the worker 10.

As shown in FIG. 2, in use the fall protection system 100 allows the worker 10 to move freely about the structure 90 in X, Y, and Z directions while remaining tethered to the fall protection traveler assembly 20. That is, the worker 10 may easily maneuver about all portions of the structure sections 92, 92' and the transverse section 94. In FIG. 2, the worker 10 is shown at approximately mid-length of the transverse member 94. Here, the support member 40 is generally disposed mid-length with the worker 10. When the worker 10 walks in the Y direction toward either of the structure sections 92, 92', the worker 10 trails the support member 40 due to the movable connection of the support member 40 upon the line 62. When the worker walks on either of the structure sections 92, 92' towards, for example, one of the vertical elements 24, the worker 10 trails the rigid member 30 by way of the pulley arrangements 50 disposed at either end of the rigid member 30 which provide for movement of the rigid member 30 relative to the flexible support elements 22. That is, as the worker moves in the X direction beneath the flexible supports 22, the rigid member is pulled by the line arrangement 60, 62 attached to the worker 10 such that the rigid member 30 travels with the worker 10.

In this way, the fall protection traveler system 20 allows the worker full freedom of movement in the X and Y directions. Additionally, the fall protection traveler system 20 allows the worker 10 to move freely in the Z direction to the extent of the length of the line arrangement 60. For example, the worker 10 connected to the system 20 may freely move atop an elevated portion 96 of the structure sections 92, 92'. Similarly, if desired, the worker 10 could descend relative to the structure sections 92, 92' and the transverse section 94. Of course, the movement in the Z direction is limited by the length from the rigid member 30 provided by the line arrangement 30. Advantageously, while moving in any of the X, Y, and Z directions the worker retains adequate fall protection from the traveler system 20, as addressed in more detail below.

Figure 3:
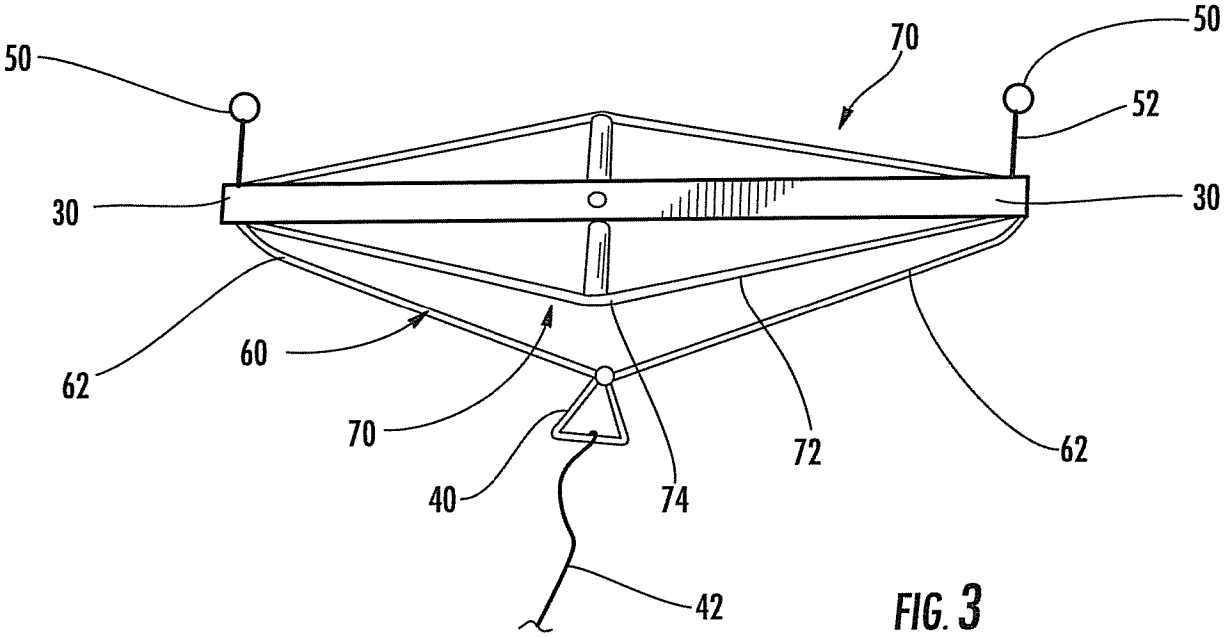
FIG. 3 is an elevation view of a rigid member of the fall protection system.

FIG. 3 shows an enlarged view of the rigid member 30. Here, the pulley arrangement 50 is shown as being connected to the rigid member 30. As shown in FIGS. 1 and 2, the pulley arrangement 50 is disposed proximate to each end of the rigid member 30. The pulley arrangement 50 may be constructed as a separate part or may be formed integral to the rigid member 30. The pulley arrangement 50 may include an extension 52 which connects the pulley arrangement 50 to the rigid member 30 and allows the rigid member 30 to hang below and unobstructed from the flexible supports 22. It is contemplated that the pulley arrangement 50 may be connected in any manner that does not interfere with the movement of the rigid member 30 along the flexible supports 22.

In another embodiment, the extension 52 is a extended portion of the line 62 which forms the line arrangement 60. In this embodiment, the line extension 52 is connected to the pulley arrangement 50 and the rigid member 30 rides upon the line arrangement 60 as discussed hereinabove.

The pulley arrangement 50 is generally configured to support and/or to secure the rigid member 30 relative to the flexible supports 22 and to provide for the movability of the rigid member 30 and the line arrangement 60 relative thereto. Depending on the configuration of the fall protection traveler assembly 20, the pulley arrangement 50 is chosen accordingly, to be movable relative to the fall protection traveler assembly 20. A pulley arrangement 50 may include but is not limited to a roller, a wheel, a ball, a bearing, a clip, a pulley or the like, or any combination of the foregoing.

The rigid member 30 may optionally include a cable stay assembly 70, as shown in FIG. 3, to provide additional buckling or bending resistance to the rigid member 30. In this exemplary embodiment, one cable stay assembly 70 is disposed on each of opposing sides of the rigid member 30. Each cable stay assembly 70 spans approximately the length of the rigid member 30 and includes a cable stay 72 and a spreader 74. The cable stay 72 is attached by any suitable means at each of the opposing ends of the rigid member 30 proximate to the pulley arrangements. The cable stay 72 generally extends the length of the rigid member 30 and traverses atop the spreader 74.

The cable stay 72 and the spreader 74 are configured to not interfere with movement of the rigid member 30 along the flexible supports 22 nor with the operation of line arrangement 60 beneath the rigid member 30. As shown in FIG. 3, the cable stays 72 are connected to the rigid member 30 so as not to interfere with the pulley arrangement 50. Additionally, the line arrangement 60 is shown hanging below and sufficiently away from the lower stay 72 and spreader 74 so that movement of the worker 10 along the is not obstructed by the cable stay assembly 70.

If the worker 10 should fall from the structure 90 while connected to the line arrangement 60, the lines 62 will exert a downward force at each opposite pulley arrangement 50. This downward force will be translated to the flexible support elements 22 which will react downwardly. This downward force will tend to pull the flexible support elements 22 inward toward one another resulting in a compression force within the rigid member 30. Any buckling that may tend to occur in reaction to this compression force will be countered and reduced or negated by the rigidity of the rigid member and/or by the tension forces in one or both of the cable stays 72 of the cable stay assembly 70.

As discussed above, the fall protection traveler assembly 20 allows the worker 10 freedom of movement in the X, Y, and Z directions on the structure 90. This is because the support member 40 is configured to move laterally in the X direction with the worker 10, the entire rigid member 30 and line arrangement 60 moves along the flexible supports 22 with the worker 10 in the Y direction, and the line arrangement 60 has sufficient slack to allow the worker to move distances in the Z direction.

Further advantageously, at all points on the structure 90, the worker 10 is provided with sufficient fall protection and, moreover, protection against dangerous swing falls. Such swing falls involve downward movement in the Z direction as well as lateral movement in the X and/or Y directions to result in a pendulum-like swing of the fallen worker 10 which can lead to a collision with the structure 90 or with equipment surrounding the structure, etc. Such swing falls occur when a worker moves laterally away from an overhead point of support. Falling from such a laterally distal position results in the dangerous swing discussed above.

The fall protection traveler assembly 20 of the invention practically negates swing falls or at least minimizes the swing involved in a fall of the worker 10. This is because the assembly 20 maintains the point of support generally above the worker during movement of the worker in all of the X, Y, and Z directions. That is, the traveling nature of the rigid support 30 upon the flexible supports 22 and the traveling nature of the support member 40 upon the lines 62, ensures that the point of support of the worker 10 is generally maintained above or at least proximate to the worker 10 despite any movements made upon the structure 90. Whether the worker 10 falls from the parallel structure sections 92, 92' or from the perpendicular transverse section 94, the worker 10 will descend generally straight downward in the Z direction with little or no movement in the X and Y directions. As mentioned, this is because the worker 10 trails the fall protection traveler assembly 20 as the worker 10 moves about the sections 92, 92', 94 of the structure 90 such that at all times the support member 40 remains proximate to the worker. Thus, a fall from any position entails only minimal or no movement in the X and Y direction and, resultantly, a minimal swing fall.

As mentioned above, in a preferred embodiment, the rigid member 30 comprises a hollow tubular member. The line 62 extends generally beneath the rigid member 30 and is connected at either end to the flexible support elements 22 at the pulley arrangements 50. The line 62 then extends downward to support the support member 40. The ends of the rigid member 30 may include a guide or pulley, etc., for fixing (movably or immovably) the line 62 thereto and/or for guiding the line 62 relative thereto In this arrangement, the rigid member 30 is supported vertically by, and generally rides upon the line 62. A downward force on the support member 40, e.g., from a fall, is translated through the line 62 and pulley arrangement 50 to the flexible support elements 22. The rigid member 30 resists horizontal forces generated at its ends due to the downward force applied to the line 62. That is, the weight of a fallen worker will pull downward on the line 62 thus creating a reaction point at either end of the rigid member 30 where the line 62 contacts and traverses the rigid member 30. The horizontal force generated at these reaction points is transferred inwardly to the rigid member which resists the resulting compression. Advantageously, this fall protection traveler assembly 20 is highly mobile and portable and may be quickly and easily assembled on any structure where fall protection is desired.

Herein, the fall protection traveler assembly 20 is discussed as being disposed upon the parallel structure sections 92, 92' and above the transverse section 94. This disposition of the assembly 20 is, of course, provided only by way of non-limiting example. The sections 92, 92', 94 may only represent a portion of the structure 90. The structure 90 may include further sections which extend away from the sections 92, 92', 94, in which case the flexible supports 22 correspondingly extend along the structure 90 to provide for maneuverability and non-swing fall protection as generally discussed above. Also, the structure sections 92, 92' are disclosed as being straight members disposed parallel to one another but may be any shape equidistant from one another. For example, the sections 92, 92' may be similarly shaped arcs which are disposed equidistant from one another. Alternatively, the sections 92, 92' may converge and/or diverge with respect to one another. The sections 92, 92' may further incline or decline relative to horizontal and/or relative to one another.

Figure 4:
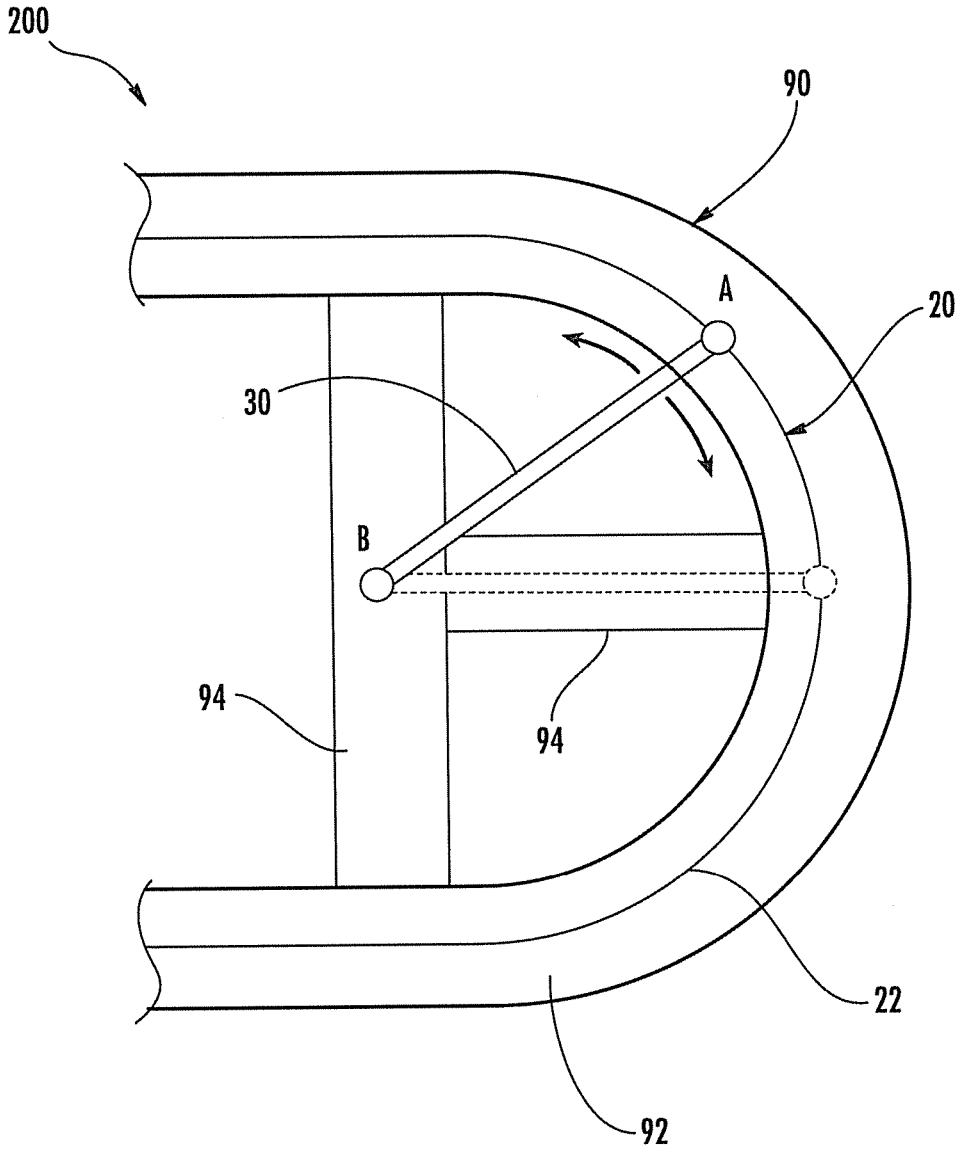
FIG. 4 is a plan view of a fall protection system in another embodiment of the invention.
Figure 6:
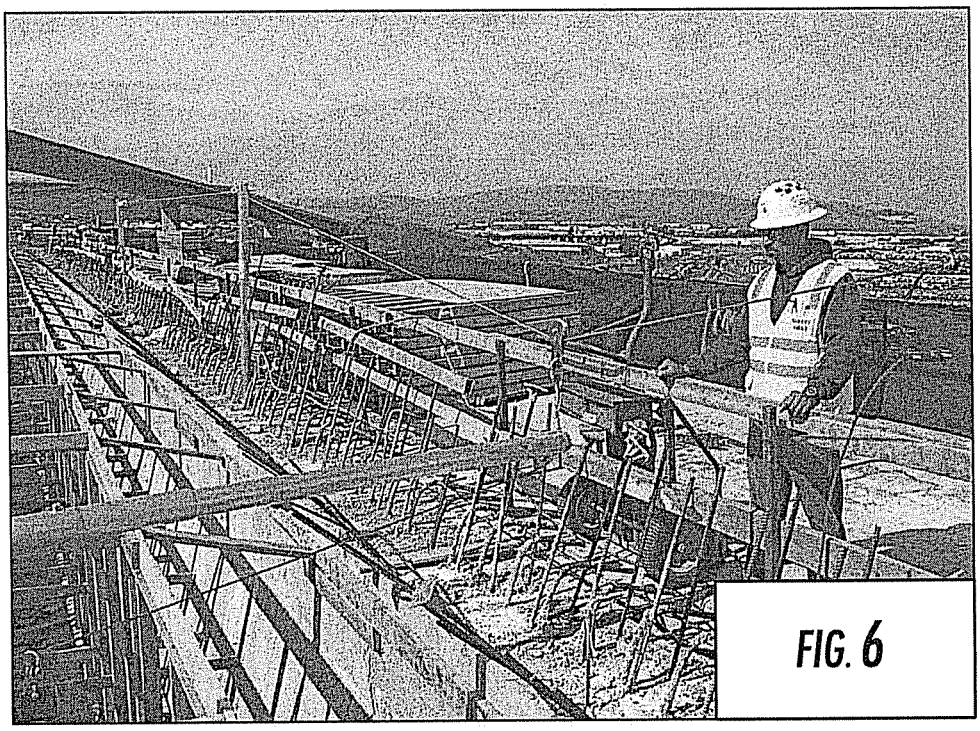
FIGS. 6-10 are photos of the invention related to the testing of FIG. 5.
Figure 7:
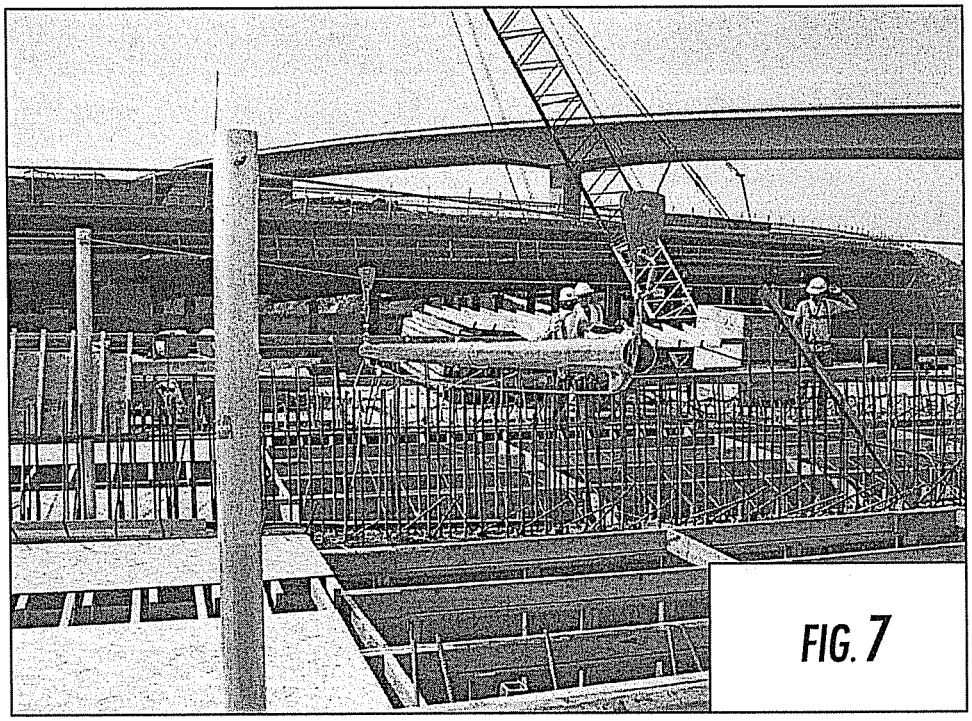
Figure 8:
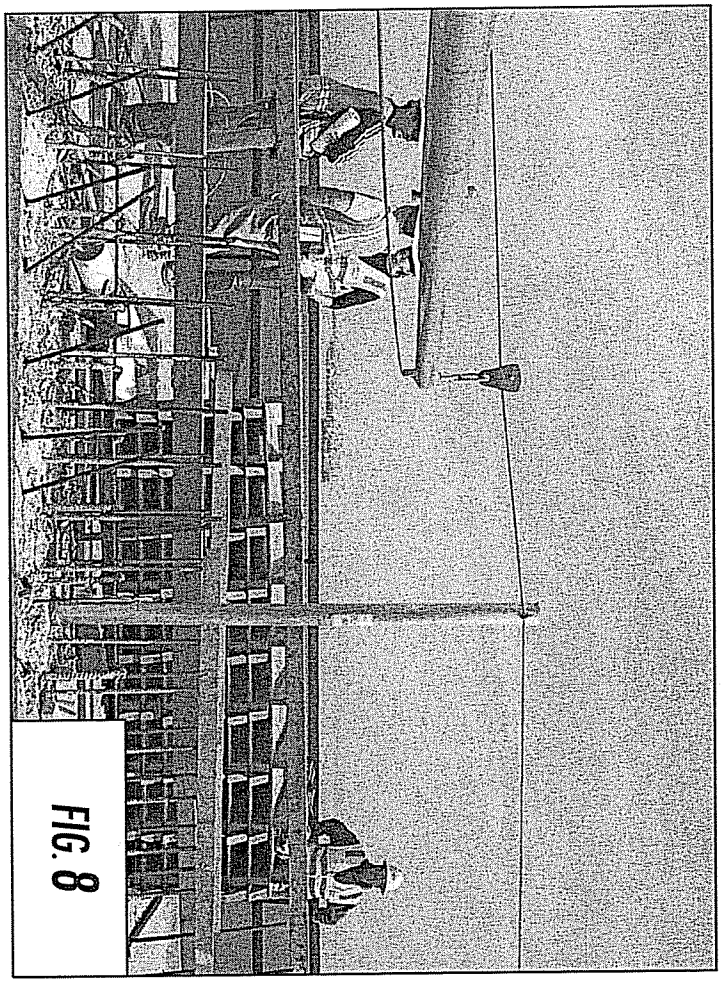
Figure 9:
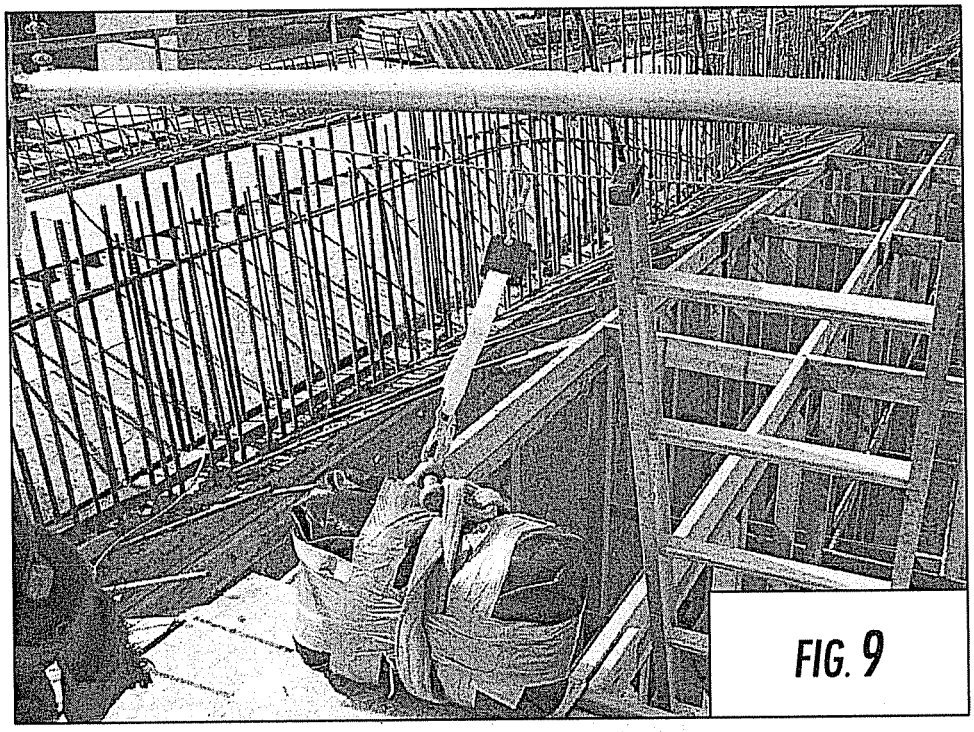
Figure 10:
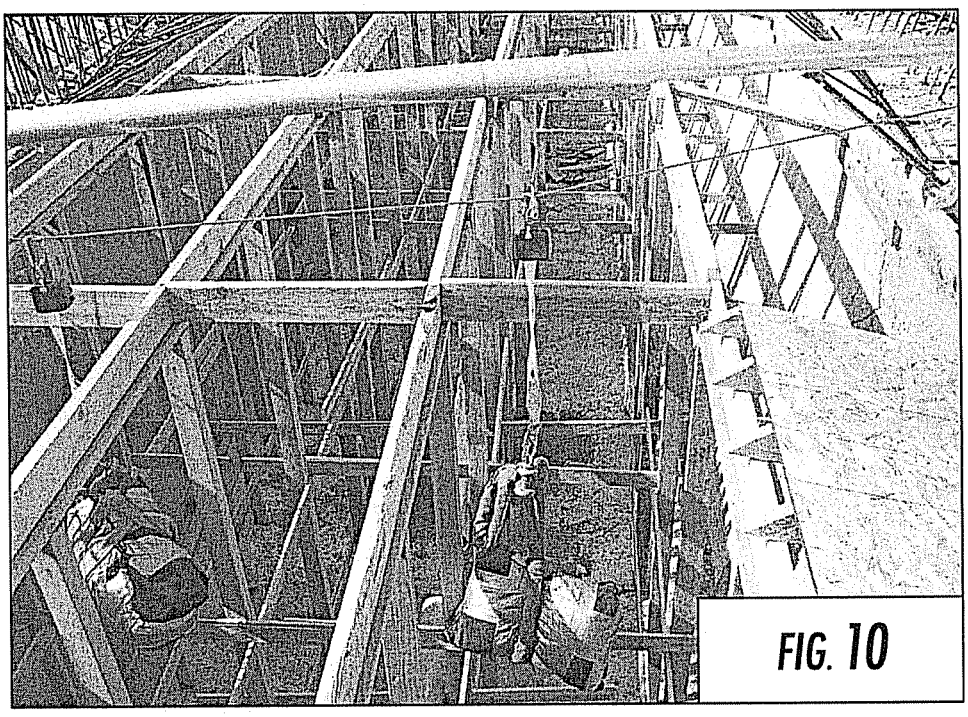

The invention further contemplates alternate arrangements of movably connecting the rigid member 30 to the fall protection traveler assembly 20. For example, FIG. 4 shows a configuration where the structure 90 includes a rounded section 92. Here, a single flexible support 22 traverses the rounded section 92 and is supported by a plurality of vertical elements 24 (not shown). An end A of the rigid member 30 is connected to the flexible support 22 by way of the pulley arrangement 50, as discussed above. An opposite end B of the rigid member 30 is fixed on a transverse section 94 of the structure 90 in such a way as to enable rotational movement of the rigid member 30 about the end B. That is, in this exemplary embodiment, the rigid member 30 is able to pivot about the end B. In this way, the worker 10 may traverse the various sections 92 and 94 of the structure 90 freely while trailing the rigid member 30 and the line arrangement 92 behind in order to provide protection against falls and particularly against swing falls, as is generally discussed above with regard to FIGS. 1-3.

The invention thus provides an advantageous fall protection system which allows an individual tethered thereto to maneuver freely about a structure in all directions while still providing fall arrest protection to the individual and, particularly, protection against swing falls, at all positions of the individual on the structure, where the fall protection system possesses a very simple construction which may be easily moved and erected on a variety of structures.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A fall protection system comprising:

a first support element;

a second support element;

a third support element extending between the first and second support elements and movably connected to the first and second support elements; and a harness connected to the third support element;

wherein the third support element comprises a tubular rigid member extending transversely between the first and second support elements and a line extending through an interior of the tubular rigid member, wherein the tubular rigid member spans the distance between the first and second support elements.

2. The fall protection system of claim 1, wherein at least one of the first and second support elements is flexible.

3. The fall protection system of claim 1, further comprising a plurality of vertical elements attached to at least one of the first and second support elements.

4. The fall protection system of claim 1, wherein at least one of the first and second support elements comprises one or more tensioning devices, shock absorbing devices, or both.

5. The fall protection system of claim 1, wherein the line forms a continuous loop.

6. The fall protection system of claim 1, wherein the harness is movable with respect to the third support element.

7. The fall protection system of claim 1, further comprising pulley arrangements movably affixing the third support element to the first and second support elements.

8. The fall protection system of claim 7, wherein the pulley arrangements movably affix the line of the third support element at one end to the first support element and at another end to the second support element.

9. The fall protection system of claim 8, wherein the third support element comprises a line arrangement attaching the harness to the third support element.

10. The fall protection system of claim 9, wherein the line arrangement comprises a support member for attaching the harness and at least one line.

11. The fall protection system of claim 10, wherein the support member is movable with respect to the line arrangement.

12. The fall protection system of claim 5, wherein the line is connected to one pulley arrangement, an opposite pulley arrangement and the support member.

13. The fall protection system of claim 9, wherein the line arrangement extends through an interior of the tubular rigid member.

14. A fall protection system comprising:

a first support element;

a second support element;

a third support element extending between the first and second support elements and movably connected to the first and second support elements, wherein the third support element comprises a tubular rigid member extending transversely between the first and second support elements and further comprises a line extending through an interior of the tubular rigid member;

and, a harness that is connected to the line that extends through the interior of the tubular rigid member by way of a connection that does not pass through, or include, the tubular rigid member.

15. The fall protection system of claim 14 wherein the tubular rigid member spans the distance between the first and second support elements.

* * * * *

UNITED STATES PATENT AND TRADEMARK OFFICE

CERTIFICATE OF CORRECTION

PATENT NO. : 8,978,820 B2
APPLICATION NO. : 11/696412
DATED : March 17, 2015
INVENTOR(S) : Solomon Marini It is certified that error appears in the above-identified patent and that said Letters Patent is hereby corrected as shown below:

In the Specification

Column 1
Line 46, Delete “a an” and insert -- an --, therefor.

Column 1
Line 46, Delete “that that” and insert -- that --, therefor.

Signed and Sealed this
Twenty-second Day of September, 2015

Michelle K. Lee

Michelle K. Lee
*Director of the United States Patent and Trademark Office*